US007251448B2

(12) United States Patent
Pozniakas et al.

(10) Patent No.: US 7,251,448 B2
(45) Date of Patent: Jul. 31, 2007

(54) CLEANING BLADE CONTROL APPARATUS AND METHOD

(75) Inventors: Robert S. Pozniakas, Rochester, NY (US); Deborah Ann Gualtieri, LeRoy, NY (US); Ahmed-Mohsen T. Shehata, Penfield, NY (US); Erwin Ruiz, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 153 days.

(21) Appl. No.: 11/217,202

(22) Filed: Aug. 31, 2005

(65) Prior Publication Data

US 2007/0048049 A1 Mar. 1, 2007

(51) Int. Cl.
*G03G 21/00* (2006.01)

(52) U.S. Cl. ..... 399/350; 399/351

(58) Field of Classification Search ..... 399/350, 399/349, 351, 345, 343, 98, 99, 100, 101; 15/1.15, 256.5, 256.51, 256.52, 356.52
See application file for complete search history.

(56) References Cited

U.S. PATENT DOCUMENTS

| | | | | | |
|---|---|---|---|---|---|
| 4,519,699 | A | | 5/1985 | Mayer et al. | 399/345 |
| 4,702,591 | A | | 10/1987 | Tsuda et al. | 399/345 |
| 4,875,081 | A | | 10/1989 | Goffe et al. | 399/343 |
| 4,969,015 | A | * | 11/1990 | Sanpe | 399/345 |
| 5,031,000 | A | * | 7/1991 | Pozniakas et al. | 399/349 |
| 5,227,852 | A | | 7/1993 | Smith et al. | 399/66 |
| 5,396,319 | A | | 3/1995 | Tokuhashi et al. | 399/351 |
| 5,412,461 | A | | 5/1995 | Thayer | 399/351 |
| 5,434,659 | A | | 7/1995 | Takarada et al. | 399/345 |
| 5,467,111 | A | * | 11/1995 | Furukawa et al. | 346/134 |
| 5,604,574 | A | | 2/1997 | Matsuura et al. | 399/350 |
| 5,669,055 | A | | 9/1997 | Thayer et al. | 399/345 |
| 5,930,575 | A | | 7/1999 | Fornalik et al. | 399/345 |
| 6,366,752 | B1 | | 4/2002 | Weber | 399/162 |
| 6,463,253 | B2 | | 10/2002 | Sato | 399/350 |
| 6,721,533 | B2 | | 4/2004 | Sato et al. | 399/350 |
| 6,873,809 | B2 | | 3/2005 | Amemiya et al. | 399/100 |
| 6,874,616 | B2 | | 4/2005 | DeVries et al. | 198/499 |
| 6,925,282 | B2 | * | 8/2005 | Drawe et al. | 399/349 |

(Continued)

FOREIGN PATENT DOCUMENTS

JP 60-163075 A * 8/1985

(Continued)

OTHER PUBLICATIONS

Airpot®, Airpot Corporation, Norwalk, CT, website http://www.airpot.com/, retrieved on Jul. 7, 2005, 1 page.

(Continued)

*Primary Examiner*—Sophia S. Chen
(74) *Attorney, Agent, or Firm*—Maginot, Moore & Beck

(57) ABSTRACT

An apparatus includes a xerographic cleaning blade, an actuator member operatively connected to the cleaning blade and movable over a first stroke from a first actuator position to a second actuator position, and a damper operatively connected to the actuator member. As the actuator member moves over the first stroke the cleaning blade moves from a first blade position to a second blade position. The damper allows substantially uninhibited actuation of the actuator member over a first portion of the first stroke. The damper damps actuation of the actuator member over a second portion of the first stroke.

20 Claims, 3 Drawing Sheets

U.S. PATENT DOCUMENTS

2003/0039490 A1* 2/2003 Obrien et al. ..... 399/316
2003/0113145 A1* 6/2003 Okabayashi ..... 399/350

FOREIGN PATENT DOCUMENTS

JP 60-169885 A * 9/1985
JP 63-008782 A * 1/1988

OTHER PUBLICATIONS

Ledex® and Dormeyer® Products, Vadalia, OH, website http://www.solenoids.com/linear-solenoids.html, retrieved Jul. 8, 2005, 2 pages.

* cited by examiner

CLEANING BLADE CONTROL APPARATUS AND METHOD

TECHNICAL FIELD

The presently disclosed embodiments are directed to a cleaning blade control apparatus and method as could be used in a number of devices such as, for example, xerographic printing devices.

BACKGROUND

The basic principles of electrostatographic printing with dry marking material (hereinafter generally referred to as "xerography," "xerographic printing," and/or the like) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in image-wise fashion from the charge receptor to a print sheet, and the print sheet is subsequently heated to permanently fuse the toner particles thereto and form a durable image. Following the transfer of the image from the charge receptor to the print sheet, residual toner particles and/or other debris left on the charge receptor are typically removed by a blade, a brush, a mesh/web, a vacuum, and/or one or more other suitable "cleaning" or "spot removal" devices. The removed debris is typically accumulated in a hopper and then directed, typically by an auger, into a waste container.

Systems that have employed one or more cleaning blades to separate the debris from their charge receptors have included solenoid driven mechanisms for engaging and disengaging the cleaning blades with the charge receptors. Solenoid drives have generally facilitated simple, low cost, and reliable cleaning blade actuation.

However, an under-damped solenoid drive can cause a cleaning blade to impact or strike the charge receptor at an undesirably high speed on engagement. The resulting abrupt change in frictional drag on the charge receptor can cause motion quality errors and associated image defects for a belt type or a drum type photoreceptor and, additionally, it can cause transverse waves and associated undesirable variations in development for a non-contacting belt type photoreceptor.

Meanwhile, an over-damped solenoid drive can prevent a cleaning blade from cycling (i.e., engaging, disengaging, and then re-engaging a charge receptor) fast enough to meet increasingly high imaging speed demands and/or from moving abruptly enough to facilitate swiping and/or throwing of residual toner from the cleaning blade.

Thus, there is a need for a solenoid driven cleaning blade control apparatus and method that can prevent the cleaning blade from impacting a charge receptor at an undesirably high speed and yet can also still cycle the cleaning blade at high speeds and/or move the cleaning blade abruptly enough to facilitate swiping and/or throwing of residual toner therefrom.

SUMMARY

According to aspects illustrated herein, there is provided an apparatus including a xerographic cleaning blade, an actuator member operatively connected to the cleaning blade and movable over a first stroke from a first actuator position to a second actuator position, and a damper operatively connected to the actuator member. As the actuator member moves over the first stroke the cleaning blade moves from a first blade position to a second blade position. The damper allows substantially uninhibited actuation of the actuator member over a first portion of the first stroke. The damper damps actuation of the actuator member over a second portion of the first stroke.

According to aspects illustrated herein, there is provided an apparatus including a photoreceptor belt, an actuator member movable from a first actuator position to a second actuator position, and a damper operatively connected to the actuator member. The damper is configured to damp actuation of the actuator member. The apparatus also includes a cleaning blade operatively connected to the actuator member. As the actuator member moves towards the second actuator position the cleaning blade engages the photoreceptor belt, and as the actuator member moves towards the first actuator position the cleaning blade disengages from the photoreceptor belt.

According to aspects illustrated herein, there is provided a method including substantially freely actuating a xerographic cleaning blade over a first portion of a range, damping actuation of the cleaning blade over a second portion of the range, and engaging the cleaning blade with a charge receptor after substantially freely actuating the cleaning blade and while damping actuation of the cleaning blade.

DETAILED DESCRIPTION

The terms "printer," "printing device," "xerographic printer," "xerographic printing device," and the like as used herein encompass any apparatus, such as a digital copier, bookmaking machine, facsimile machine, multi-function machine, etc. which forms a print outputting function for any purpose. Additionally, the terms "cleaning blade," "cleaner blade," "xerographic cleaning blade," "xerographic cleaner blade," "spots blade," "spots removal blade," and the like as used herein encompass any edged or blade-like member or device that is configured to remove residual toner particles and/or other debris from an imaging surface.

Figure 1:
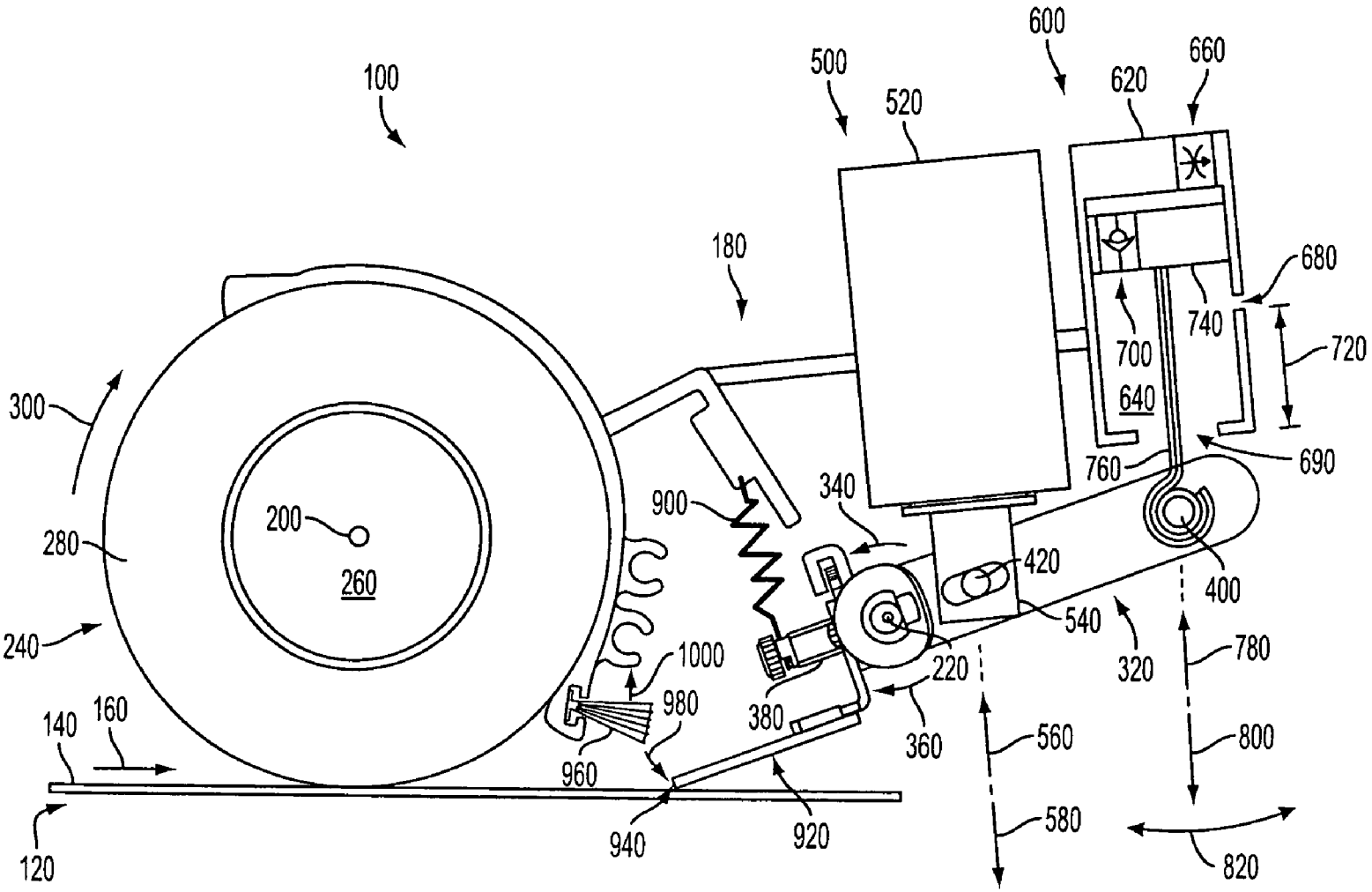
FIG. 1 is a simplified elevational diagrammatical view showing relevant elements of an exemplary apparatus in one position.

FIG. 1 is a simplified elevational diagrammatical view showing relevant elements of an exemplary apparatus 100 in one position. Apparatus 100 may be incorporated into a suitable overall xerographic printing device 1100 (see FIG. 3) or any other suitable printing device that includes a suitable charge receptor 120 having a suitable charge-retentive surface 140. As discussed further in connection with FIG. 3, device 1100 (see FIG. 3) may be configured to create an electrostatic latent image (not shown) on surface 140, to develop the latent image by exposing it to toner particles (not shown), to transfer at least some of the toner particles in image-wise fashion from surface 140 to a print sheet or other suitable medium 1180 (see FIG. 3), to form a durable image (not shown) on the medium by heating the medium and permanently fusing toner particles thereto, and to advance charge receptor 120 as generally indicated by arrow 160. In the exemplary embodiment, charge receptor 120 is a non-contacting photoreceptor belt. In alternative embodiments, charge receptor 120 may be a contacting photoreceptor belt, a contacting photoreceptor drum, or any other suitable charge receptor. Additionally, although the exemplary embodiment shown includes a photoreceptor belt it is noted that alternative embodiments may be used with any other suitable type of belt such as an intermediate transfer belt for some types of color printing. As discussed further below, in the exemplary embodiment apparatus 100 is configured to, among other things, remove residual toner particles (not shown) and/or other debris from surface 140.

Apparatus 100 includes a substantially fixed support structure 180. Structure 180 is made from a suitably rigid and durable metal, plastic, and/or other suitable material or combination of materials. Structure 180 includes an axle member 200 and an axle member 220.

Apparatus 100 further includes a brush roller or roller brush 240. Brush 240 is configured and positioned to, among other things, remove at least some residual toner particles and/or other debris from surface 140, and is made from a suitably rigid and durable metal, plastic, and/or other suitable material or combination of materials. Brush 240 includes a generally cylindrical core 260 rotably coupled to member 200. Brush 240 further includes a plurality of bristles 280 extending generally radially outwardly from core 260 to reach surface 140. Apparatus 100 is configured to, among other things, suitably rotate brush 240 about member 200 as generally indicated by arrow 300.

Apparatus 100 further includes a lever arm 320 pivotally coupled to member 220. Arm 320 is made from a suitably rigid and durable metal, plastic, and/or other suitable material or combination of materials. Arm 320 is configured to, among other things, suitably pivot about member 220 as generally indicated by arrow 340 and arrow 360 and to be coupled to other parts of apparatus 100 as discussed further below. Arm 320 includes an end portion forming a generally cylindrical stud-like member 380, an axle member 400 positioned proximally to an opposing end portion, and an axle member 420 positioned between member 220 and member 400 such that member 220 is positioned between member 380 and member 420.

Apparatus 100 further includes a linear solenoid actuator 500. Actuator 500 includes a housing 520 fixedly coupled to structure 180 and further includes a shaft 540 having an end linearly movably positioned in housing 520 and further having an opposing end pivotally coupled to member 420. Actuator 500 is configured to, among other things, generally linearly move shaft 540 somewhat inwardly into housing 520 (as generally indicated by an arrow 560) over an inward shaft stroke from a position in which actuator 500 is de-energized and shaft 540 is relatively extended from housing 520 (see FIG. 2) to an opposing (or "pull in") position in which actuator 500 is energized and shaft 540 is relatively retracted into housing 520. Conversely, actuator 500 is also configured to, among other things, allow shaft 540 to be generally linearly moved somewhat outwardly from housing 520 (as generally indicated by an arrow 580) over an opposing outward shaft stroke (from the aforementioned relatively retracted, energized position back to the aforementioned relatively extended, de-energized position). Apparatus 100 also includes suitable electronic control circuitry (not shown) configured to automatically energize and de-energize actuator 500 during operation.

Apparatus 100 further includes a linear motion air damper 600. Damper 600 includes a housing 620 forming a piston chamber 640 having an adjustable flow valve 660, having an inlet/outlet delay port or orifice 680, and having a wide opening 690. Orifice 680 is spaced apart from the widely opened end of chamber 640 by a distance 720. Damper 600 also includes a check valve 700 and a piston head 740. Valve 700 extends through head 740, and head 740 is movable within chamber 640. Damper 600 further includes a rod 760 extending through opening 690 with an end pivotally coupled to head 740 and an opposing end pivotally coupled to member 400. Damper 600 is configured to, among other things, allow generally linear movement of rod 760 somewhat inwardly into housing 620 (as generally indicated by an arrow 780) over an inward rod stroke from a position in which head 740 is distal to valve 660 and rod 760 is relatively extended from housing 620 (see FIG. 2) to an opposing position in which head 740 is proximal to valve 660 and rod 760 is relatively retracted into housing 620. Additionally, it is noted that damper 600 is configured to allow non-damped (i.e., "substantially uninhibited") movement of rod 760 over a portion of the inward rod stroke in which head 740 moves (generally axially in the direction of arrow 780) from the end of chamber 640 to orifice 680, while damper 600 is also configured to damp movement of rod 760 over a portion of the inward rod stroke in which head 740 moves (generally axially in the direction of arrow 780) from orifice 680 to valve 660. Damper 600 is also configured to, among other things, allow non-damped (i.e., "substantially uninhibited") generally linear movement of rod 760 somewhat outwardly from housing 620 (as generally indicated by an arrow 800) over an opposing outward rod stroke (from the aforementioned relatively retracted position back to the aforementioned relatively extended position). Meanwhile, opening 690 provides clearance for generally lateral movements or rocking of rod 760 during operation as generally indicated by arrows 820. Selection of distance 720 and selection of a suitable damping coefficient for the portion of the inward rod stroke in which head 740 moves from orifice 680 to valve 660 (i.e., the damped portion of the inward stroke) are discussed below. In alternative embodiments, damper 600 may be replaced with any other suitably configured pneumatic damper, hydraulic ("liquid") damper, or other type of motion damper.

Figure 2:
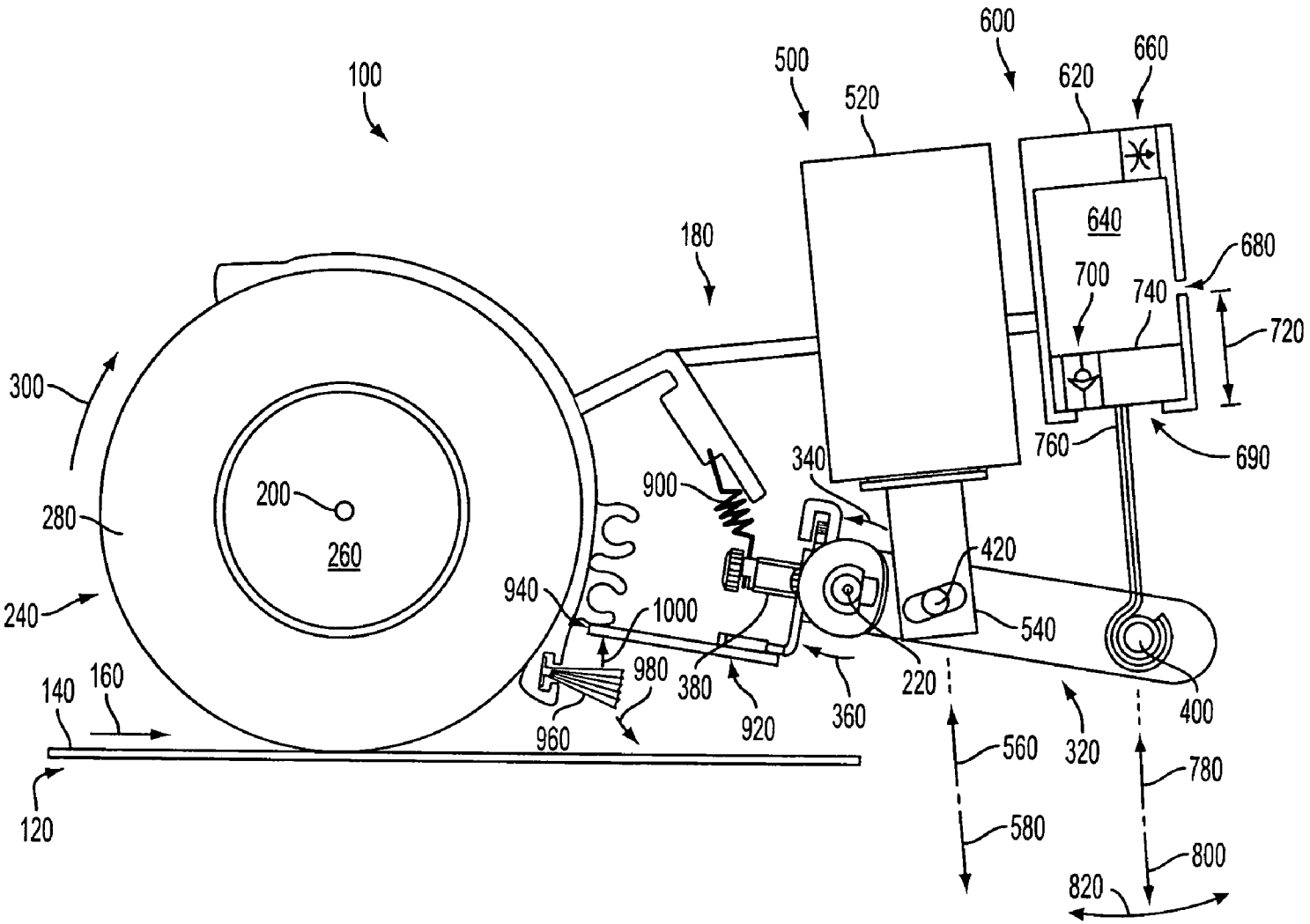
FIG. 2 is a simplified elevational diagrammatical view showing relevant elements of the exemplary apparatus in another position.

FIG. 2 is a simplified elevational diagrammatical view showing relevant elements of apparatus 100 in another position. As at least partially discernable from a comparison of FIG. 1 and FIG. 2, apparatus 100 further includes a coiled spring 900 extending from structure 180 to portion 380 (of arm 320). Spring 900 is configured and positioned such that when actuator 500 is energized and shaft 540 consequently moves over its inward shaft stroke and causes arm 320 to pivot about member 220 (as generally indicated by arrow 340), portion 380 moves to stretch spring 900 and, conversely, when actuator 500 is de-energized spring 900 contracts and consequently causes arm 320 to pivot about member 220 (as generally indicated by arrow 360) which in turn causes shaft 540 to move over its outward shaft stroke. Spring 900 is made from a suitably rigid and durable metal, plastic, and/or other suitable material or combination of materials.

Apparatus 100 further includes a xerographic cleaning blade 920 having an edge portion 940, and apparatus 100 further includes a whisk broom like swiper brush 960. As at least partially discernable from a comparison of FIG. 1 and FIG. 2, blade 920 is fixedly coupled to and extends from portion 380 (of arm 320) and brush 960 is fixed coupled to and extends from structure 180 such that as shaft 540 (of actuator 500) moves over its inward shaft stroke portion 940

(of blade 920) moves generally arcuately (as indicated by arrow 980) out of engagement with structure 180, then into engagement with brush 960, then out of engagement with brush 960, and then into engagement with surface 140 (of charge receptor 120) and, conversely, as shaft 540 moves over its outward shaft stroke portion 940 moves generally arcuately (as indicated by arrow 1000) out of engagement with surface 140, then into engagement with brush 960, then out of engagement with brush 960, and then into engagement with structure 180. Blade 920 is made from a suitably rigid and durable metal, plastic, and/or other suitable material or combination of materials. Brush 960 is made from a suitably rigid and durable metal, plastic, and/or other suitable material or combination of materials. Distance 720 is predetermined and fixed such that damper 600 allows substantially uninhibited movement of rod 760 (and thus, substantially uninhibited actuation of shaft 540 and in turn substantially uninhibited actuation of blade 920) until after portion 940 (of blade 920) moves out of engagement with brush 960, and the damping coefficient for the damped portion of the inward stroke of shaft 540 is predetermined and then fixed (via suitable adjustment of valve 660) such that blade 920 does not strike or impact surface 140 at an undesirably high speed during operation.

In operation, apparatus 100 automatically advances charge receptor 120 (as generally indicated by arrow 160), rotates brush 240 about member 200 (as generally indicated by arrow 300), and energizes/de-energizes actuator 500 (and thus actuates blade 920) to desirably remove residual toner particles and/or other debris from surface 140. By damping the actuation of blade 920, apparatus 100 prevents blade 920 from impacting charge receptor 120 at an undesirably high speed. However, as apparatus 100 delays the damping until after portion 940 moves through its engagement with brush 960, apparatus 100 ensures that portion 940 strikes or impacts brush 960 with sufficient force and/or speed for brush 960 to more effectively prevent undesirable buildups of residual toner particles and/or other debris on blade 920. Moreover, by delaying the damping as shaft 540 (of actuator 500) moves over its inward shaft stroke and by avoiding damping altogether as shaft 540 moves over its outward shaft stroke apparatus 100 facilitates higher speed cycling of blade 920.

Figure 3:
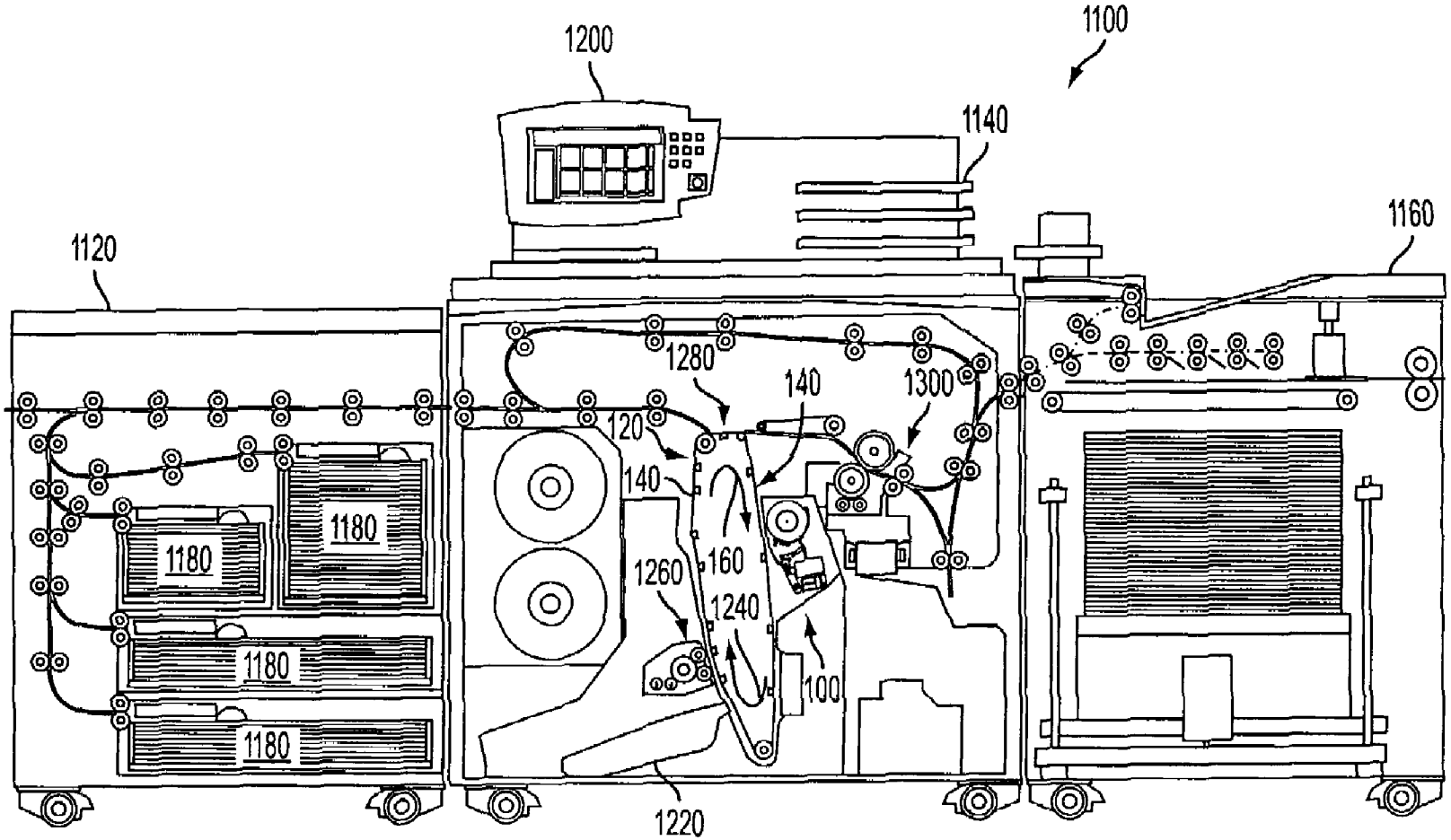
FIG. 3 is an elevational view of an exemplary xerographic printing device which incorporates the exemplary apparatus.

FIG. 3 is an elevational view of an exemplary xerographic printing device 1100 which incorporates apparatus 100. Device 1100 is but one exemplary environment in which apparatus 100 may be used and it is not intended to limit the use of apparatus 100 to any particular machine or device.

Device 1100 includes a feeder unit 1120, a printing unit 1140, and an output unit 1160. Feeder unit 1120 houses supplies of media sheets and/or other substrates 1180 onto which document images are transferred by printing unit 1140. Printing unit 1140 includes an operator console 1200 where job tickets may be reviewed and/or modified for print jobs performed by device 1100. Pages to be printed during a print job may be scanned by device 1100 or received over an electrical communication link. The page images are used to generate bit data that is provided to a raster output scanner ("ROS") 1220 for forming a latent image on charge receptor 120. Charge receptor 120 continuously travels circuitously in the direction(s) generally indicated by arrow 160 (see also FIG. 1 and FIG. 2) and arrow 1240.

Device 1100 further includes a development subsystem 1260 that develops toner on charge receptor 120, and further includes a transfer station 1280. The overall function of subsystem 1260 is to apply marking material, such as toner, onto suitably charged areas forming a latent image on surface 140 of charge receptor 120 in a manner generally known in the art. Various alternative devices may include multiple development subsystems 1260, such as one for each primary color for color printing or other purposes. Transfer station 1280 generates electric fields that transfer toner conforming to the latent image(s) to substrate(s) 1180.

Device 1100 further includes a fuser station 1300. Device 100 transports substrates 1180 bearing toner images to fuser station 1300 where fuser station 1300 fixes toner images to substrates 1180. Device 1100 then transports substrates 1180 to output unit 1160. Output unit 1160 correlates and/or stacks substrates 1180 to which images have been fixed in trays for pickup.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus, comprising:

a xerographic cleaning blade;

an actuator member operatively connected to the cleaning blade and movable over a first stroke from a first actuator position to a second actuator position; and a damper operatively connected to the actuator member;

wherein as the actuator member moves over the first stroke the cleaning blade moves from a first blade position to a second blade position, the damper allows substantially uninhibited actuation of the actuator member over a first portion of the first stroke, and the damper damps actuation of the actuator member over a second portion of the first stroke.

2. The apparatus of claim 1, further comprising:

a belt;

wherein as the cleaning blade moves towards the second blade position the cleaning blade engages the belt, and as the cleaning blade moves towards the first blade position the cleaning blade disengages from the belt.

3. The apparatus of claim 2, wherein the belt includes a charge receptor.

4. The apparatus of claim 3, wherein the charge receptor includes a photoreceptor.

5. The apparatus of claim 1, wherein the actuator member is movable over a second stroke from the second actuator position to the first actuator position, and the damper allows substantially uninhibited actuation of the actuator member over at least a substantial portion of the second stroke.

6. The apparatus of claim 5, further comprising:

a charge receptor;

wherein as the cleaning blade moves towards the second blade position the cleaning blade engages the charge receptor, and as the cleaning blade moves towards the first blade position the cleaning blade disengages from the charge receptor.

7. The apparatus of claim 6, wherein the charge receptor includes a belt.

8. The apparatus of claim 7, wherein the belt includes a photoreceptor.

9. The apparatus of claim 7, further comprising:

a brush positioned such that as the cleaning blade moves between the second blade position and the first blade position the cleaning blade temporarily engages the brush.

10. The apparatus of claim 1, wherein the damper includes an air damper having a delay port.

11. The apparatus of claim 10, further comprising:

a solenoid actuator;

wherein the actuator member is part of the solenoid actuator.

12. The apparatus of claim 11, further comprising:

a charge receptor;

wherein as the cleaning blade moves towards the second blade position the cleaning blade engages the charge receptor, and as the cleaning blade moves towards the first blade position the cleaning blade disengages from the charge receptor.

13. The apparatus of claim 12, wherein the charge receptor includes a belt.

14. The apparatus of claim 13, wherein the belt includes a photoreceptor.

15. The apparatus of claim 13, further comprising:

a brush positioned such that as the cleaning blade moves between the second blade position and the first blade position the cleaning blade temporarily engages the brush.

16. An apparatus, comprising:

a photoreceptor belt;

an actuator member movable from a first actuator position to a second actuator position;

a damper operatively connected to the actuator member, the damper configured to damp actuation of the actuator member; and a cleaning blade operatively connected to the actuator member;

wherein as the actuator member moves towards the second actuator position the cleaning blade moves to engage the photoreceptor belt and the damper allows substantially uninhibited actuation of the actuator member during a first portion of the movement of the actuator towards the second actuator position and the damper dampens actuation of the actuator member during a second portion of the movement of the actuator towards the second actuator position.

17. The apparatus of claim 16, further comprising:

a solenoid actuator;

wherein the actuator member is part of the solenoid actuator, and the damper includes an air damper having a delay port.

18. A method comprising:

substantially freely actuating a xerographic cleaning blade over a first portion of a range;

damping actuation of the cleaning blade over a second portion of the range; and engaging the cleaning blade with a charge receptor after substantially freely actuating the cleaning blade and while damping actuation of the cleaning blade.

19. The method of claim 18, wherein engaging the cleaning blade with a charge receptor includes engaging the cleaning blade with a photoreceptor belt.

20. The method of claim 19, further comprising:

brushing the cleaning blade while substantially freely actuating the cleaning blade and before damping actuation of the cleaning blade.

* * * * *